United States Patent [19]

Witt

[11] Patent Number: 5,005,484

[45] Date of Patent: Apr. 9, 1991

[54] PROJECTILE FOR FIRING FROM AN ELECTROMAGNETIC PROJECTILE ACCELERATION DEVICE

[75] Inventor: Wolfram Witt, Düsseldorf, Fed. Rep. of Germany

[73] Assignee: Rheinmetall GmbH, Dusseldorf, Fed. Rep. of Germany

[21] Appl. No.: 68,480

[22] Filed: Jun. 12, 1987

Related U.S. Application Data

[63] Continuation-in-part of Ser. No. 50,170, May 7, 1987, abandoned.

[30] Foreign Application Priority Data

May 9, 1986 [DE] Fed. Rep. of Germany ..... 3615585

[51] Int. Cl.[5] ..... F42B 10/00

[52] U.S. Cl. ..... 102/501; 89/8; 102/521; 102/517

[58] Field of Search ..... 102/501, 514, 515, 517, 102/520–523; 89/8

[56] References Cited

U.S. PATENT DOCUMENTS

| | | | |
|---|---|---|---|
| H237 | 3/1987 | Levy | 102/517 |
| 3,000,316 | 9/1961 | Dunlap et al. | 102/523 |
| 4,347,463 | 8/1982 | Kemeny et al. | 89/8 |
| 4,534,263 | 8/1985 | Heyne et al. | 89/8 |
| 4,555,972 | 12/1985 | Heyne . | |
| 4,625,618 | 12/1986 | Howanick | 89/8 |
| 4,638,739 | 1/1987 | Sayles | 102/520 |
| 4,694,729 | 9/1987 | Hall | 89/8 |
| 4,708,065 | 11/1987 | Schilling et al. | 102/501 |

FOREIGN PATENT DOCUMENTS

| | | | |
|---|---|---|---|
| 3325868 | 1/1984 | Fed. Rep. of Germany . | |
| 448496 | 6/1936 | United Kingdom | 89/8 |

*Primary Examiner*—Harold J. Tudor
*Attorney, Agent, or Firm*—Spencer & Frank

[57] ABSTRACT

A projectile which is intended for firing from an electromagnetic projectile acceleration device equipped with parallel acceleration rails and forming a plasma arc cushion. To realize high speeds as well as uniform stress on the projectile during the acceleration phase, the projectile, when seen in the direction of flight, is composed of at least two spaced partial projectile sections which are arranged one behind the other and are separated from one another by intermediate projectile portions, and plasma forming substances are disposed at the rear ends of the respective partial projectile sections.

13 Claims, 3 Drawing Sheets

PROJECTILE FOR FIRING FROM AN ELECTROMAGNETIC PROJECTILE ACCELERATION DEVICE

CROSS REFERENCE TO RELATED APPLICATION

This application is a continuation-in-part of applicant's copending U.S. application Ser. No. 07/050,170, filed May 7, 1987 now abandoned.

BACKGROUND OF THE INVENTION

The present invention relates to projectiles of the type which are fired from an electromagnetic projectile acceleration device provided with parallel acceleration rails for forming a plasma arc cushion.

In principle, electromagnetic projectile acceleration devices are composed of an acceleration member which, in the simplest case, is constituted by two parallel acceleration rails normally disposed in a tube. These rails are traversed by current and simultaneously take over the lateral guidance of the projectile. When a current is switched on, the current flows along the one rail, through an armature arranged to move between the two rails, and then back through the other rail. The magnetic fields thus generated between the rails, while current is flowing through the armature, generate a Lorenz force which propels the armature and the projectile connected or associated with the armature toward the outside.

In principle, the armature may be composed of a solid material. However, the necessary brush contacts between the armature and the rails do not permit velocities of more than about 1000 m/sec. For some time, a change has therefore been made to the use of a plasma arc cushion as the armature.

Such a plasma arc cushion can be, for example, produced by a thin metal foil which, when traversed by a high intensity current, evaporates to form an electrically conductive plasma cloud. Corresponding electromagnetic projectile acceleration devices are disclosed, for example, in DE-OS 3,325,868 and in DE-OS 3,344,636, corresponding to U.S. Pat. No. 4,555,972, issued Dec. 3rd, 1985.

A particular drawback of the prior art devices is the fact that the force to accelerate the projectile is transmitted only through the bottom or rear of the projectile. Therefore, the projectile must be made correspondingly stable, similarly to conventional projectiles accelerated by a propellant charge.

SUMMARY OF THE INVENTION

It is an object of the present invention to improve projectiles of the type fired from an electromagnetic acceleration device to the extent that, on the one hand, they are accelerated to high velocities and, on the other hand, the force transmission required for the acceleration is effected as uniformly as possible over the entire projectile.

The above object is accomplished according to the present invention in that in a projectile of the type to be fired from an electromagnetic projectile acceleration device provided with parallel acceleration rails for forming a plasma arc cushion, the projectile, when seen in the direction of flight, includes at least two partial projectile sections which are arranged one behind the other and are separated from one another by intermediate projectile portions, and plasma forming substances are disposed at the rear ends of the respective partial projectile sections.

According to the disclosed embodiment of the invention the intermediate projectile portions extend along the longitudinal axis of said projectile and have a diameter which is less than that of said partial projectile sections.

Moreover, according to the preferred embodiment of the invention, the projectile is a subcaliber projectile and the partial projectile sections are provided with propelling cage sabots, which preferably are disposed at the rear ends of the partial projectile sections with the plasma forming substances being disposed on the rear of the cages. In a conventional manner, the sabots have a diameter which is greater than that of the partial projectile sections.

Finally, according to a feature of the invention, the plasma forming substances preferably are metal foils.

BRIEF DESCRIPTION OF THE DRAWINGS

The invention will be described below with reference to embodiments which are illustrated in the drawing figures wherein.

DETAILED DESCRIPTION OF THE PREFERRED EMBODIMENTS

Figure 1:
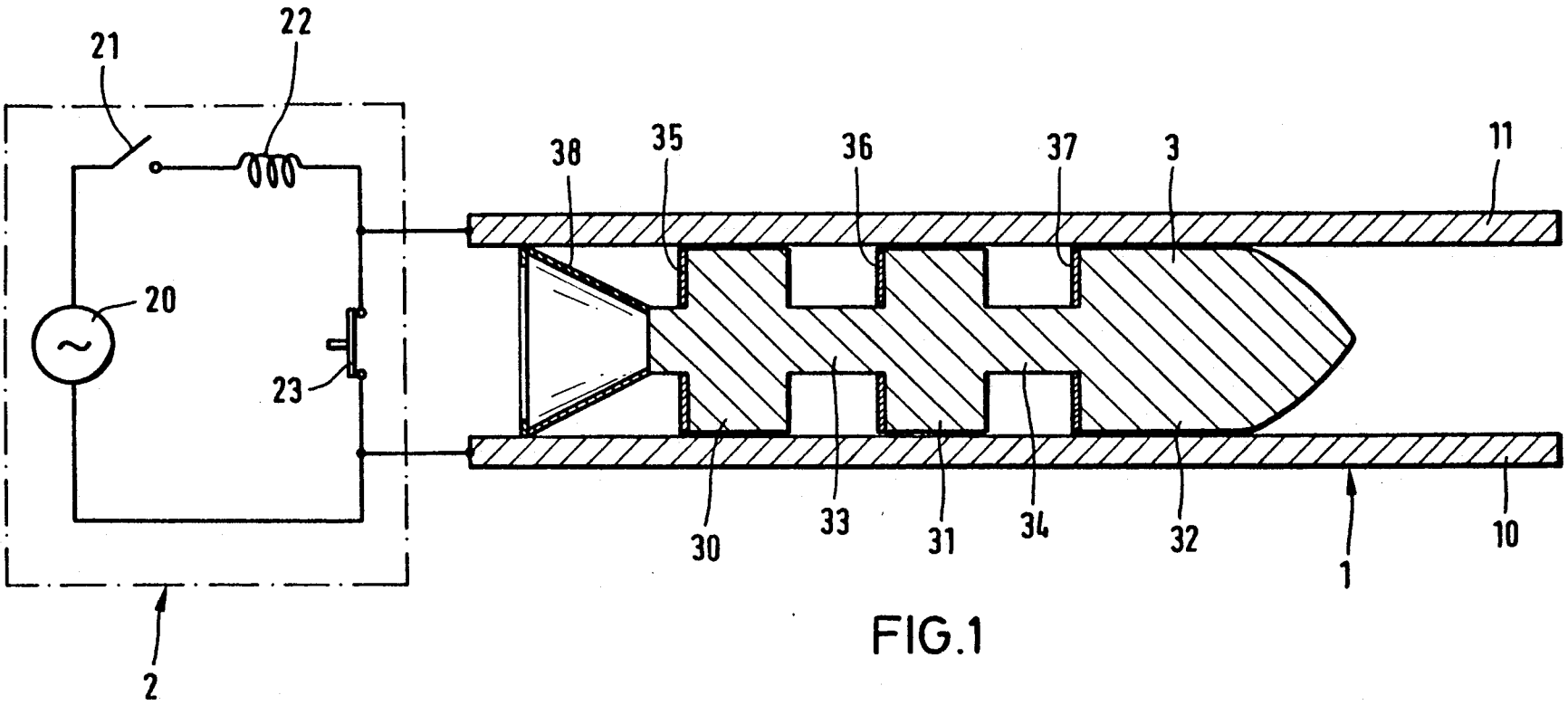
FIG. 1 is a schematic representation of a projectile acceleration device including a projectile according to one embodiment of the invention.

In FIG. 1, the numeral 1 identifies a conventional electromagnetic projectile acceleration device basically composed of parallel acceleration rails 10 and 11 which are normally disposed in the inner surface of a tube, for example as shown in the above mentioned U.S. Pat. No. 4,555,972. Connected with the rails is a current generator 2. Disposed between the acceleration rails 10 and 11 is a projectile 3 according to one embodiment of the invention.

The current generator is essentially composed of the series connection of a generator 20, a first switch 21, an inductance 22 and a second switch 23, with the switch 23 additionally being connected between the rails 10 and 11.

The projectile 3 according to the invention is comprised of a plurality of partial projectile sections 30, 31 and 32 which are disposed in a longitudinally spaced relationship, one behind the other in the direction of flight of the projectile, and a guide assembly 38. The exemplarily illustrated guide assembly 38 is a conical guide assembly. Partial projectile sections 30, 31 and 32 are each separated from one another by intermediate projectile portions 33 and 34. As shown, the portions 33 and 34 extend along the longitudinal axis of the projectile and have a diameter which is less than that of the projectile sections 30, 31 and 32 so as to form annular spaces between adjacent partial sections.

Disposed at or on the rear end of each partial projectile section 30, 31 and 32 are respective plasma forming substances 35, 36 and 37, preferably metal foils as shown. These metal foils 35, 36 and 37 serve, in a known manner, to generate a respective plasma cushion behind each of the sections 30, 31 and 32 which acts as an armature, and accelerates the projectile. As metal foils 35, 35 and 37, aluminum and copper foils of about 1 mm thickness can be used.

In contrast to prior art projectiles, the force transmission to accelerate the projectile 3 is not effected with the aid of a single plasma cushion but with a plurality of plasma arcs generated along the projectile. As is well known for projectiles of the type, the partial projectile sections 30, 31 and 32 must have an electrically nonconductive projectile casing or coating (not shown in FIG. 1) so that no current transfer occurs through the sections 30, 31 or 32 during the acceleration process.

The operation of the electromagnetic projectile acceleration device according to FIG. 1 will now be described briefly.

Initially, switches 21 and 23 of current generator 2 are closed. This causes generator 20 to charge the inductive energy store 22. Then switch 23 is opened, thus generating a voltage across rails 10 and 11. The corresponding current must be strong enough that metal foils 35, 36 and 37 evaporate into electrically conductive plasma clouds. Thus an electric arc is generated at the end or rear of each of the respective partial projectile sections 30, 31 and 32 and a closed circuit is formed composed of inductive energy store 22, acceleration rails 10 and 11 and the plasma cushions behind the respective partial projectile sections 30, 31 and 32. The current flow generated in this manner causes projectile 3 to be electromagnetically accelerated so that it reaches very high velocities.

When projectile 3 leaves acceleration rails 10 and 11, switch 23 closes so that now the inductive energy store 22 is recharged for the next firing process.

Figure 3:
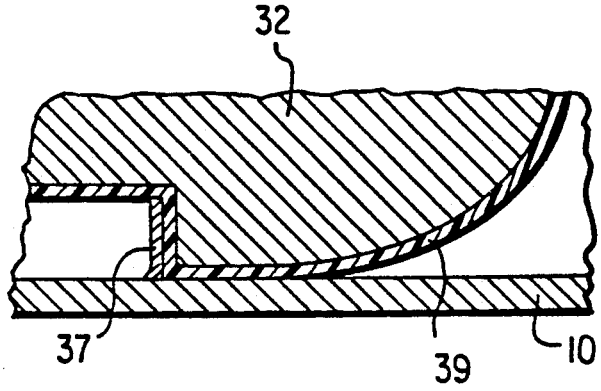
FIG. 3 is a schematic representation of a part of the projectile of FIG. 1 in greater detail.

FIG. 3 shows the projectile 32 in greater detail. The numerals 37 and 10 identify again the plasma forming substance (metal foil) and the acceleration rail, respectively. The projectile 32 is coated with a nonconductive casing 39, so that the current will be conducted from the rail 10 through the metal foil 37.

Figure 2:
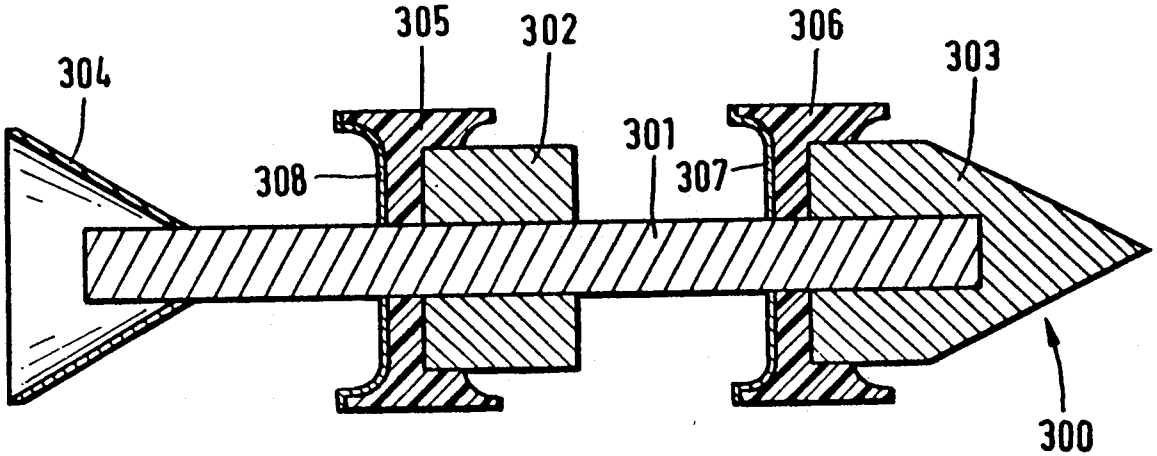
FIG. 2 is a schematic sectional view of a further embodiment of a projectile according to the invention.

Referring now to FIG. 2 a further, preferred embodiment of the projectile will be described below. This projectile 300 is composed of an axially extending carrier member 301 on which are disposed spaced partial projectile sections 302 and 303 and a, for example, conical, guide mechanism 304. As with the embodiment of FIG. 1, the diameter of the sections 302, 303 is greater than that of the carrier member 301. As seen in the direction of flight of the projectile, propelling cage sabots 305 and 306 are disposed at the respective rear ends of the partial projectile sections 302 and 303. On the one hand, these propelling cage sabots 302 and 303 serve to assure guidance of the subcaliber projectile 300 between the metal rails of the acceleration device. On the other hand, the propelling cage sabots 305, 306 act as carriers for the plasma generating foils 308 and 307, respectively.

The operation of the projectile 300 of FIG. 2 during the acceleration phase essentially corresponds to that of the above described projectile 3 of FIG. 1.

Figure 2A:
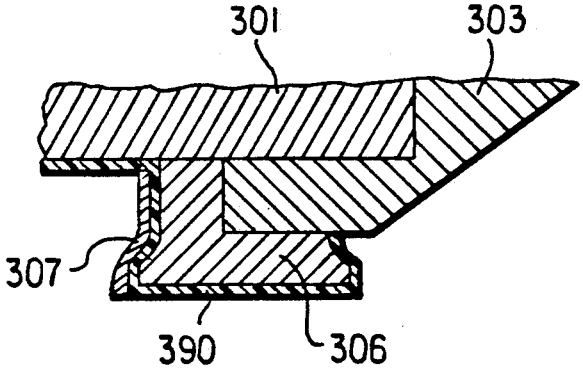
FIG. 2*a* is a schematic representation of a part of the projectile of FIG. 2 in greater detail.

The sabots 305 and 306 can be formed of nonconductive material (for example, of fibre reinforced plastic) or of conductive material (for example, aluminum). If a conductive material is used for the sabot, it is necessary to use a nonconductive casing or coating 390 as shown in FIG. 2*a* and in a manner similar to that as shown in FIG. 3.

The metal foils extend to the periphery but do not contact the carrier member 301. As material for the parts 32 (FIG. 1) and 301 and 302 (FIG. 2), steel or tungsten, etc. has been used.

It will be understood that the above description of the present invention is susceptible to various modifications, changes and adaptations, and the same are intended to be comprehended within the meaning and range of equivalents of the appended claims.

What is claimed is:

1. In a projectile of the type to be fired from an electromagnetic projectile acceleration device provided with parallel acceleration rails for forming a plasma arc cushion, the improvement wherein: said projectile, when seen in the direction of flight, includes at least two partial projectile sections which are arranged one behind the other and are separated from one another by intermediate projectile portions; and respective plasma forming substances are disposed at rear ends of the respective said partial projectile sections.

2. A projectile as defined in claim 1 wherein said intermediate projectile portions extend along the longitudinal axis of said projectile and have a diameter which is less than that of said partial projectile sections.

3. A projectile as defined in claim 1, wherein: said projectile is a subcaliber projectile; and said partial projectile sections are provided with propelling cage sabots.

4. A projectile as defined in claim 3, wherein said propelling cage sabots are disposed at the rear ends of said partial projectile sections; and said plasma forming substances are disposed on said sabots.

5. A projectile as defined in claim 4 wherein: said intermediate projectile portions extend along the longitudinal axis of said projectile and have a diameter which is less than that of said partial projectile sections; and said sabots have a diameter which is greater than that of said partial projectile sections.

6. A projectile as defined in claim 1 wherein said plasma forming substances are respective metal foils which evaporate, when traversed by a high intensity current, to form said plasma cushion.

7. A projectile as defined in claim 6 wherein: said projectile is formed of a conductive material: and means are provided for electrically insulating said metal foils from said projectile.

8. A projectile as defined in claim 7 wherein said means for electrically insulating includes a layer of insulation material disposed between each of said metal foils and said projectile.

9. A projectile as defined in claim 5 wherein said plasma forming substances are respective metal foils which evaporate when traversed by a high intensity current to form said plasma cushion.

10. A projectile as defined in claim 9 wherein at least one of said projectile and said sabots are formed of conductive material; and further comprising means for electrically insulating the respective said metal foils from said at least one of said projectile and said sabots.

11. In a projectile of the type to be fired from an electromagnetic projectile acceleration device provided with parallel acceleration rails for producing a plasma arc cushion for accelerating the projectile when a current passes between the rails via a plasma forming substance disposed on the projectile; the improvement wherein said projectile, when seen in the direction of flight, includes at least two spaced sections of a first diameter which are disposed one behind the other and are spaced from one another by an intermediate projectile portion which extends along the longitudinal axis of said projectile and has a diameter less than that of said first diameter; and respective conductive plasma forming substances, disposed at a respective rear end of each of said spaced sections, for producing a plasma cushion behind each of said sections during acceleration of said projectile.

12. A projectile as defined in claim 11 wherein: said projectile is a subcaliber sabot projectile; said spaced sections each include a respective propelling cage sabot; and each of said conductive plasma forming substances is disposed on a rear radial surface of a respective said propelling cage sabot.

13. A projectile as defined in claim 11 wherein said conductive plasma forming substances are respective metal foils which evaporate to form said plasma cushions.

* * * * *